US010961811B2

(12) United States Patent
Zeng

(10) Patent No.: US 10,961,811 B2
(45) Date of Patent: Mar. 30, 2021

(54) DISSOLVABLE BRIDGE PLUG

(71) Applicants: Qijun "Liam" Zeng, Albuquerque, NM (US); VERTECHS OIL & GAS TECHNOLOGY USA COMPANY LLC, Albuquerque, NM (US)

(72) Inventor: Qijun "Liam" Zeng, Albuquerque, NM (US)

(73) Assignee: Vertechs Oil & Gas Technology USA Company LLC, Albuquerque, NM (US)

( * ) Notice: Subject to any disclaimer, the term of this patent is extended or adjusted under 35 U.S.C. 154(b) by 0 days.

(21) Appl. No.: 16/496,867

(22) PCT Filed: Mar. 24, 2017

(86) PCT No.: PCT/US2017/024117
§ 371 (c)(1),
(2) Date: Sep. 23, 2019

(87) PCT Pub. No.: WO2018/174902
PCT Pub. Date: Sep. 27, 2018

(65) Prior Publication Data

US 2020/0018135 A1 Jan. 16, 2020

(51) Int. Cl.
*E21B 33/129* (2006.01)
*E21B 29/02* (2006.01)
*E21B 33/128* (2006.01)

(52) U.S. Cl.
CPC ..... *E21B 33/1293* (2013.01); *E21B 29/02* (2013.01); *E21B 33/128* (2013.01)

(58) Field of Classification Search
CPC .... E21B 23/06; E21B 33/1204; E21B 33/129; E21B 33/1291; E21B 33/134
See application file for complete search history.

(56) References Cited

U.S. PATENT DOCUMENTS 2,230,447 A * 2/1941 Bassinger ..... E21B 33/134 166/128
3,082,824 A * 3/1963 Taylor ..... E21B 33/1293 166/134
3,160,209 A * 12/1964 Bonner ..... E21B 23/065 166/63
4,493,374 A * 1/1985 Magee, Jr. ..... E21B 33/1295 166/106
4,708,202 A * 11/1987 Sukup ..... E21B 33/1204 166/122

(Continued)

*Primary Examiner* — Robert E Fuller
(74) *Attorney, Agent, or Firm* — Arch & Lake LLP

(57) ABSTRACT

The dissolvable bridge plug is designed for temporarily plugging an oil and gas wellbore, and includes a mandrel, a rubber tube, a conical sleeve, a slip, and a lower sub, wherein, the mandrel, rubber tube, conical sleeve, slip, and lower sub are made of a dissolvable material. The inner surface of one end of the lower sub is arranged with an anti-preset mechanism that contacts with the other end of the mandrel. As the temperature in the wellbore is recovered and meets the condition under which the components in the bridge plug can be dissolved after the setting and fracturing operation is completed. The dissolvable bridge plug contacts with the fluids in the oil and gas well and has a dissolution reaction with the fluids, and finally is dissolved into fine particles completely.

9 Claims, 4 Drawing Sheets

(56) References Cited

U.S. PATENT DOCUMENTS

| | | | | |
|---|---|---|---|---|
| 5,685,372 | A * | 11/1997 | Gano | E21B 23/00 166/292 |
| 7,373,973 | B2 * | 5/2008 | Smith | E21B 33/1216 166/134 |
| 8,079,413 | B2 * | 12/2011 | Frazier | E21B 33/134 166/124 |
| 9,309,744 | B2 * | 4/2016 | Frazier | E21B 33/134 |
| 2007/0227745 | A1 * | 10/2007 | Roberts | E21B 23/06 166/386 |
| 2013/0240203 | A1 * | 9/2013 | Frazier | E21B 33/134 166/193 |
| 2016/0061001 | A1 * | 3/2016 | Fitzhugh | E21B 23/06 166/386 |

* cited by examiner

DISSOLVABLE BRIDGE PLUG

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the technical field of downhole tools for temporarily plugging the inside diameter of the casing in staged fracturing stimulation of oil and gas wells, in particular to a dissolvable bridge plug.

2. Description of Related Art Including Information Disclosed Under 37 CFR 1.97 and 37 CFR 1.98

In staged fracturing stimulation of oil and gas wells, usually composite bridge plugs or big-bore cast iron bridge plugs are used as staging tools. The two types of bridge plugs have their own advantages respectively. For example, composite bridge plugs have a characteristic of quick drilling and milling, i.e., after the fracturing operation is finished, the composite bridge plugs can be drilled and milled off quickly via the coiled tubing so that a full-bore accessed wellbore can be formed, in order to obtain higher oil and gas production output; however, the drilling and milling cost is high, the drilling and milling becomes more difficult and relevant risks become higher as the drilling and milling depth is increased; in addition, in the staged fracturing stimulation of some deep wells, composite bridge plugs can't be used because the drilling and milling depth is limited by the length of the coiled tubing.

Cast iron bridge plugs applied in staged fracturing stimulation are usually big-bore bridge plugs, which have a large inner diameter and the well could directly flow-back after the fracturing operation is finished; in addition, since big-bore cast iron bridge plugs don't require drilling and milling, costs and risks related with drilling and milling are eliminated. The oil and gas output of an oil and gas well decreases as the well's life increases. Hence, secondary stimulation of oil and gas well becomes an important approach for increasing the oil and gas output. However, if big-bore cast iron bridge plugs are used for staged fracturing of the wellbore, a restriction in casing inner diameter (i.e., the inner diameter of the big-bore cast iron bridge plugs) will be formed, limiting the methods of secondary stimulation and resulting in impacts on the effect of secondary stimulation.

In summary, though a full-bore accessed wellbore can be formed after drilling and milling of composite bridge plugs, the drilling and milling cost and relevant risks are high; though big-bore cast iron bridge plugs can be put into operation directly without drilling and milling, they cause a restricted inner diameter of the wellbore and limit the secondary stimulation of the oil and gas well.

BRIEF SUMMARY OF THE INVENTION

The present invention provides a dissolvable bridge plug, to solve the above-mentioned technical problem that existing bridge plugs require drilling and milling and have impacts on secondary stimulation in actual application.

To solve the above-mentioned technical problem, the present invention provides a dissolvable bridge plug for setting an oil and gas wellbore, comprising a mandrel, a rubber tube, a conical sleeve, a slip, and a lower sub, wherein, the mandrel is in a hollow structure, with a limiting boss arranged on one end of the mandrel, the rubber tube and the conical sleeve are slidably fitted over the outer surface of the mandrel sequentially, the smaller end of the conical sleeve is away from one side of the rubber tube, and one end of the rubber tube contacts with the limiting boss; the slip comprises a plurality of slips disposed on the conical surface of the conical sleeve via a radial limiting structure, one end of the lower sub is slidably fitted over the other end of the mandrel and abuts against the slips, the other end of the lower sub is connected with a setting tool adapter; wherein, the mandrel, rubber tube, conical sleeve, slip, and lower sub are made of a dissolvable material; the inner surface of one end of the lower sub is arranged with an anti-preset mechanism that contacts with the other end of the mandrel.

The beneficial effects of the present invention include: since the mandrel, rubber tube, conical sleeve, slip, and lower sub are made of a dissolvable material, one end of the setting tool adapter can be fixedly connected to the other end of the lower sub, the entire bridge plug can be placed into the oil and gas wellbore, and then the setting process of the dissolvable bridge plug can be controlled in the setting process. As the temperature in the wellbore is recovered and meets the condition under which the components in the bridge plug can be dissolved after the fracturing is completed, the dissolvable bridge plug contacts with the fluids in the oil and gas well and has a dissolution reaction with the fluids, and finally is dissolved completely; thus, the internal diameter of the oil and gas wellbore is smooth; thus, a full-bore accessed wellbore can be formed without drilling and milling, and a restricted inner diameter of the wellbore can be avoided. In actual application, if the operator or equipment manipulates the setting tool adapter incorrectly before the bridge plug is placed to the preset position in the oil and gas wellbore, the setting tool adapter will pull the lower sub, and thereby setting will be initiated; with the anti-present mechanism, the setting function of the bridge plug will not be initiated even the pulling force on the lower sub is lower than the set value of the anti-preset mechanism owing to a misoperation; thus, the reliability of the bridge plug is improved.

Furthermore, the anti-preset mechanism is a protruding structure arranged on the inner surface of the lower sub, and is integral with the lower sub.

A beneficial effect of the above-mentioned further scheme is: with the anti-preset mechanism in a protruding structure, the structure is reliable; in addition, since the boss and the lower sub are formed into an integral structure, the product is easy to process.

Furthermore, the inner surface of the other end of the lower sub is arranged with threads connected with the setting tool adapter.

A beneficial effect of the above-mentioned further scheme is: since the lower sub is connected with the setting tool adapter by means of threads, the quantity, pitch, and specification of the threads can be adjusted, so that the setting tool adapter can be pulled off from the lower sub under different pulling forces; thus, threads in different specifications can be arranged according to the operating conditions of the bridge plugs and the downhole environment, to achieve different shearing forces for the setting tool adapter and the lower sub.

Furthermore, a one-way locking mechanism configured to prevent the conical sleeve from sliding freely towards the other end of the mandrel is arranged between the inner surface of the conical sleeve and the mandrel.

A beneficial effect of the above-mentioned further scheme is: in the setting process of the bridge plug, the lower sub squeezes the slip, and the slip squeezes the conical sleeve in turn; thereby, the rubber tube is squeezed to deform towards one end of the mandrel, so that the outer surface of the rubber tube seals the inner surface of the wellbore under the squeezing force; with the one-way locking mechanism, the conical sleeve will not slide towards the other end of the mandrel, and thereby the reliability of the bridge plug in the setting process is improved.

Furthermore, the inner surface of the conical sleeve is arranged with an annular groove in the circumferential direction, the one-way locking mechanism comprises a locking block engaged with the mandrel via one-way limiting teeth, and the locking block is disposed in the annular groove and can move radially in the annular groove.

A beneficial effect of the above-mentioned further scheme is: the locking block in the one-way locking mechanism can move radially in the annular groove; thus, the one-way limiting teeth will not be worn in the setting process, and the limiting effect attained by the engagement between the locking block and the mandrel via the one-way limiting teeth will not be compromised.

Furthermore, the end surface of the other end of the lower sub is arranged with a guide channel through which the well fluid can flow.

A beneficial effect of the above-mentioned further scheme is: in actual application of the products, multiple bridge plugs are used together, and one end of the mandrel in the bridge plug seals the inner diameter of the mandrel by means of a sealing ball; when the sealing ball of the lower dissolvable bridge plug moves to the setting position the dissolvable bridge plug, the sealing ball will come into contact with the bottom of the lower sub, but will not seal the guide channel or block the inner diameter of the mandrel of the dissolvable bridge plug.

Furthermore, the slip has a slip gap, the length direction of the slip gap is parallel to the axis of the mandrel, and the slip gap extends from the outer surface of the slip towards the interior of the slip.

A beneficial effect of the above-mentioned further scheme is: in the setting process of the bridge plug, the slip will expand and deform outwards under the squeezing force at the two ends. The slip gap is helpful for anchoring the slip to the inner diameter of the wellbore.

Furthermore, the outer surface of the slip is arranged with a one-way slip anchoring structure configured to restrict the slip from sliding on the inner wall of the wellbore towards the other end of the mandrel.

A beneficial effect of the above-mentioned further scheme is: with the one-way slip anchoring structure, the slip is firmly anchored to the inner wall of the wellbore, and thus the bridge plug setting efficiency and setting reliability are improved.

Furthermore, a plurality of slips are evenly distributed on the outer surface of the mandrel in the circumferential direction.

A beneficial effect of the above-mentioned further scheme is: since a plurality of slips are evenly distributed on the outer surface of the mandrel in the circumferential direction, the anchoring force is evenly distributed on the inner wall of the wellbore, and thereby the anchoring stability of the slip on the inner wall of the wellbore is improved.

Furthermore, the end surface of one end of the mandrel is in a concave shape.

A beneficial effect of the above-mentioned further scheme is: the concave end surface of one end of the mandrel can contact well with the sealing ball and attains a good sealing effect; thus, a stable and reliable one-way load bearing effect of the bridge plug is attained.

In the figures, the components represented by the symbols are listed as follows: 1—slip; 2—conical sleeve; 3—mandrel; 4—lower sub; 5—guide channel; 6—rubber tube; 7—one-way locking mechanism; 8—anti-present mechanism

DETAILED DESCRIPTION OF THE INVENTION

Hereunder the present invention will be detailed in embodiments, with reference to the accompanying drawings.

Figure 1:
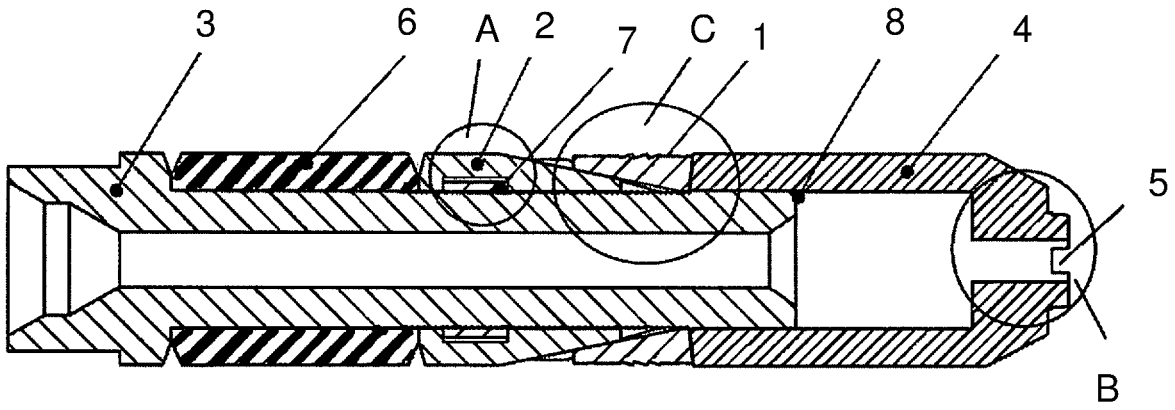
FIG. 1 is a sectional view of a structural diagram of an embodiment of the dissolvable bridge plug according to the present invention.

A sectional structural diagram of an embodiment of the dissolvable bridge plug according to the present invention is shown in FIG. 1. The dissolvable bridge plug is a dissolvable bridge plug for plugging an oil and gas wellbore, comprising a mandrel 3, a rubber tube 6, a conical sleeve 2, a slip 1, and a lower sub 4, wherein, the mandrel 3 is a hollow structure, with a limiting boss arranged on one end of the mandrel 3, the rubber tube 6 and the conical sleeve 2 are slidably fitted over the outer surface of the mandrel 3 sequentially, the smaller end of the conical sleeve 2 is away from one side of the rubber tube 6, and one end of the rubber tube 6 contacts with the limiting boss; the slip 1 comprises a plurality of slips 1 disposed on the conical surface of the conical sleeve 2 via a radial limiting structure, one end of the lower sub 4 is slidably fitted over the other end of the mandrel 3 and abuts against the slips 1, the other end of the lower sub 4 is connected with a setting tool adapter; wherein, the mandrel 3, rubber tube 6, conical sleeve 2, slip 1, and lower sub 4 are made of a dissolvable material; the inner surface of one end of the lower sub 4 is arranged with an anti-preset mechanism 8 that contacts with the other end of the mandrel 3.

Since the mandrel 3, rubber tube 6, conical sleeve 2, slip 1, and lower sub 4 are made of a dissolvable material that can be dissolved in a water solution at 30° C.-200° C. temperature, one end of the setting tool adapter can be fixedly connected to the other end of the lower sub 4, the entire bridge plug can be placed into the oil and gas wellbore, and then the setting of the dissolvable bridge plug can be controlled in the setting process; as the temperature in the wellbore is recovered and meets the condition under which the components in the bridge plug can be dissolved after the fracturing is completed, the dissolvable bridge plug contacts with the fluids in the oil and gas well and has a dissolution reaction with the fluids, and finally is dissolved completely; thus, the internal diameter of the oil and gas wellbore is smooth; thus, a full-bore accessed wellbore can be formed without drilling and milling, and a restricted inner diameter of the wellbore can be avoided. In actual application, if the operator or equipment manipulates the setting tool adapter incorrectly before the bridge plug is placed to the preset position in the oil and gas wellbore, the setting tool adapter will pull the lower sub 4, and thereby setting will be initiated; with the anti-preset mechanism 8, the setting function of the bridge plug will not be initiated even the pulling force on the lower sub 4 is lower than the set value of the anti-preset mechanism 8 owing to a misoperation; thus, the reliability of the bridge plug is improved.

In this embodiment, the anti-preset mechanism 8 is a protruding structure arranged on the inner surface of the lower sub 4, and is integral with the lower sub 4.

With the anti-preset mechanism 8 in a protruding structure, the structure is reliable; in addition, since the boss and the lower sub 4 are formed into an integral structure, the product is easy to process.

In specific embodiments, the anti-preset mechanism 8 can be arranged in different shapes with different shearing force values according to the specific working conditions and environment. For example, the anti-preset mechanism 8 may be configured in an annular boss structure or a plurality of boss structures on the inner surface of the lower sub 4 in the circumferential direction.

In this embodiment, the inner surface of the other end of the lower sub 4 is arranged with threads connected with the setting tool adapter.

Since the lower sub 4 is connected with the setting tool adapter by means of threads, the quantity, pitch, and specification of the threads can be adjusted, so that the setting tool adapter can be pulled off from the lower sub 4 under different pulling forces; thus, threads in different specifications can be arranged according to the operating conditions of the bridge plugs and the downhole environment, to achieve different shearing forces for the setting tool adapter and the lower sub 4.

In this embodiment, a one-way locking mechanism 7 configured to prevent the conical sleeve 2 from sliding freely towards the other end of the mandrel 3 is arranged between the inner surface of the conical sleeve 2 and the mandrel 3.

In the setting process of the bridge plug, the lower sub 4 squeezes the slip, and the slip squeezes the conical sleeve 2 in turn; thereby, the rubber tube 6 is squeezed to deform towards one end of the mandrel 3, so that the outer surface of the rubber tube 6 seals the inner surface of the wellbore under the squeezing force; with the one-way locking mechanism 7, the conical sleeve 2 will not slide towards the other end of the mandrel 3, and thereby the reliability of the bridge plug in the setting process is improved.

In this embodiment, the inner surface of the conical sleeve 2 is arranged with an annular groove in the circumferential direction, the one-way locking mechanism 7 comprises a locking block engaged with the mandrel 3 via one-way limiting teeth, and the locking block is disposed in the annular groove and can move radially in the annular groove.

The locking block in the one-way locking mechanism 7 can move radially in the annular groove; thus, the one-way limiting teeth will not be worn in the setting process, and the limiting effect attained by the engagement between the locking block and the mandrel 3 via the one-way limiting teeth will not be compromised.

In this embodiment, the end surface of the other end of the lower sub 4 is arranged with a guide channel 5 through which the well fluid can flow.

In actual application of the products, multiple bridge plugs are used together, and one end of the mandrel 3 in the bridge plug seals the inner diameter of the mandrel 3 by means of a sealing ball; when the sealing ball of the lower dissolvable bridge plug moves to the setting position the dissolvable bridge plug, the sealing ball will come into contact with the bottom of the lower sub, but will not seal the guide channel 5 or block the inner diameter of the mandrel of the dissolvable bridge plug.

In this embodiment, the slip 1 has a slip gap, the length direction of the slip gap is parallel to the axis of the mandrel 3, and the slip gap extends from the outer surface of the slip 1 towards the interior of the slip 1.

In the setting process of the bridge plug, the slip will expand and deform outwards under the squeezing force at the two ends. The slip gap is helpful for anchoring the slip to the inner diameter of the wellbore.

In this embodiment, the outer surface of the slip 1 is arranged with a one-way slip anchoring structure configured to restrict the slip 1 from sliding on the inner wall of the wellbore towards the other end of the mandrel 3.

With the one-way slip anchoring structure, the slip is firmly anchored to the inner wall of the wellbore, and thus the bridge plug setting efficiency and setting reliability are improved.

In this embodiment, a plurality of slips 1 are evenly distributed on the outer surface of the mandrel 3 in the circumferential direction.

Since a plurality of slips are evenly distributed on the outer surface of the mandrel 3 in the circumferential direction, the anchoring force is evenly distributed on the inner wall of the wellbore, and thereby the anchoring stability of the slip on the inner wall of the wellbore is improved.

In this embodiment, the end surface of one end of the mandrel 3 is in a concave shape.

The concave end surface of one end of the mandrel 3 can contact well with the sealing ball and attains a good sealing effect; thus, a stable and reliable one-way load bearing effect of the bridge plug is attained.

When the dissolvable bridge plug is used for setting, one end of a pull rod in the setting tool adapter is fixedly connected to the other end of the lower sub 4, and the sleeve of the setting tool adapter abuts against the limiting boss of the mandrel 3. In the setting process, the pull rod and the sleeve move towards each other under the external force applied by the setting tool; thus, the lower sub 4 drives the slip 1 and the conical sleeve 2 to squeeze the rubber tube 6, so that the rubber tube 6 is deformed and the outer surface of the rubber tube 6 tightly contacts with the inner wall of the oil and gas wellbore; when the pulling force on the pull rod is greater than the force of connection between the lower sub 4 and the pull rod in the setting tool adapter via the threads as the external force is applied further, the pull rod will be sheared off from the lower sub 4; at that point, the rubber tube 6 fully seals the inner wall of the oil and gas wellbore, and the slip 1 is fully anchored to the inner wall of the oil and gas wellbore. After the setting of the dissolvable bridge plug is finished, the setting tool can be withdrawn, and a dissolvable fracturing ball in corresponding size can be thrown into the well mouth. In a vertical bore section, the dissolvable fracturing ball can fall by gravity to a ball cup on the top of the mandrel 3 of the dissolvable bridge plug; in a horizontal bore section, the dissolvable fracturing ball can be pushed to the ball cup on the top of the mandrel 3 of the dissolvable bridge plug by injecting a fluid. After the fracturing ball falls onto the ball cup, sealing between the ball and the ball cup can be achieved by injecting a fracturing fluid via a fracturing pump continuously to apply pressure to the ball; in addition, the fracturing fluid will enter into the strata through the perforations and begin to fracture the strata. When the fracturing fluid pumped into the strata reaches to the design volume, the fracturing operation is completed.

In specific embodiments, the slip 1, conical sleeve 2, mandrel 3, lower sub 4, one-way locking mechanism 7, and anti-preset mechanism 8 may be made of magnesium-aluminum alloy; the rubber tube 6 is usually made of a dissolvable rubber material. The magnesium-aluminum alloy is made by adding Mg, Sn, C, Zn elements and the like into aluminum alloy that serves as a base material and is made dissolvable utilizing an electrochemical principle by adding rare earth elements into the aluminum alloy material to destroy the dense oxide film of the aluminum alloy material so that the aluminum alloy material is not protected by an oxide film; in addition, the content of the rare earth elements is controlled to control the destroy rate of the oxide film of the aluminum alloy and ultimately control the dissolution rate of the metal material. The temperature of the downhole fluid is usually 30° C.-200° C. In the fluid environment of downhole water solution, the magnesium-aluminum alloy has an electrochemical reaction with chloride ions and thereby is dissolved. Dissolvable rubber loses strength and is decomposed, and finally is dissolved into a mud form during long-term contact with the high-temperature downhole water solution.

Figure 2:
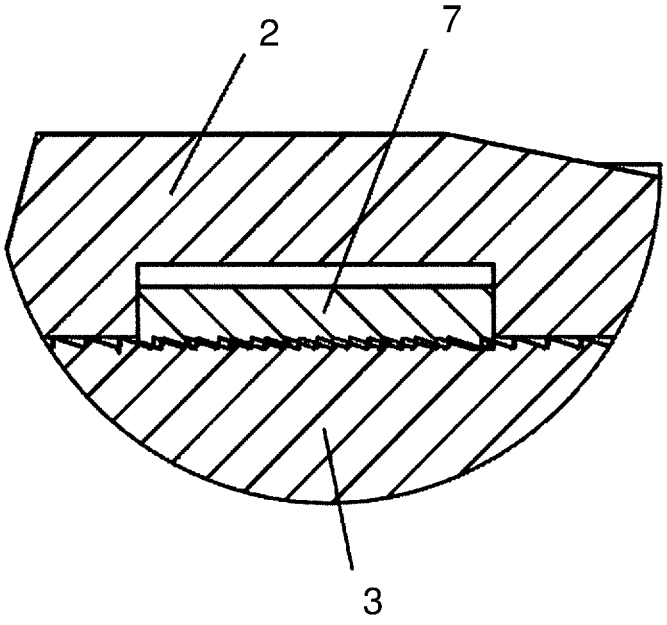
FIG. 2 is a structural diagram of the part A in FIG. 1.

The structure of the part A in FIG. 1 is shown in FIG. 2. The inner surface of the conical sleeve 2 is arranged with an annular groove in the circumferential direction, the one-way locking mechanism 7 comprises a locking block engaged with the mandrel 3 via one-way limiting teeth, and the locking block is disposed in the annular groove and can move radially in the annular groove, wherein, the locking block in the one-way locking mechanism 7 may consists of two semicircular components; when the conical sleeve 2 moves towards the rubber tube 6 and squeezes, the locking block will move radially in the annular groove, and will be jammed in the rightward direction shown in the figure and can't move rightwards owing to the engagement of the one-way limiting teeth; thus, the conical sleeve 2 also can't move rightwards, and the conical sleeve 2 and the limiting boss of the mandrel 3 always maintain enough squeezing pressure on the rubber tube 6; especially, after the setting is finished, the sealing performance of the rubber tube 6 will not be affected after the setting tool is removed; thus, the reliability of the dissolvable bridge plug is greatly improved.

In specific embodiments, the locking block in the one-way locking mechanism 7 may be configured in different quantities and structures to improve locking reliability; in addition, the depth of engagement of the one-way limiting teeth can be set to attain different locking effects.

Figure 3:
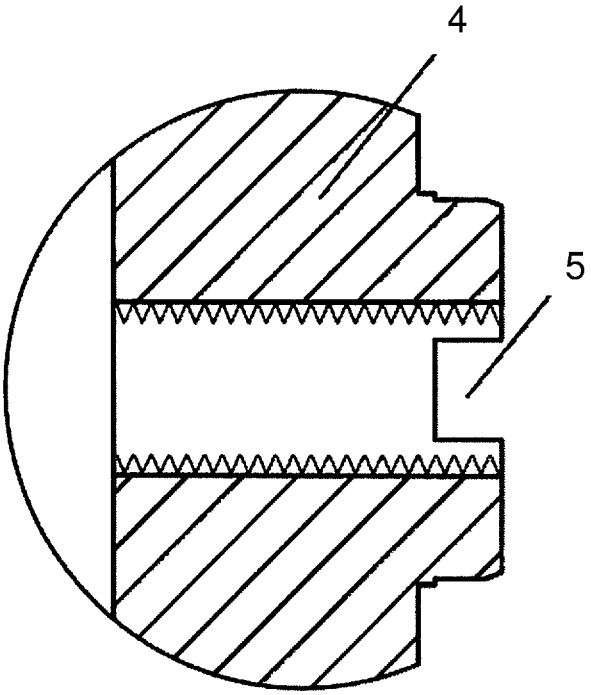
FIG. 3 is a structural diagram of the part B in FIG. 1.

The structure of the part B in FIG. 1 is shown in FIG. 3. The inner surface of the other end of the lower sub 4 is arranged with threads connected with the setting tool adapter. In actual application, the threads can be configured in different nominal diameters, different specifications, and different quantities to attain different shearing forces.

Since the lower sub 4 is connected with the setting tool adapter by means of threads, the quantity, pitch, and specification of the threads can be adjusted, so that the setting tool adapter can be pulled off from the lower sub 4 under different pulling forces; thus, threads in different specifications can be arranged according to the operating conditions of the bridge plugs and the downhole environment, to achieve different shearing forces for the setting tool adapter and the lower sub 4.

Figure 4:
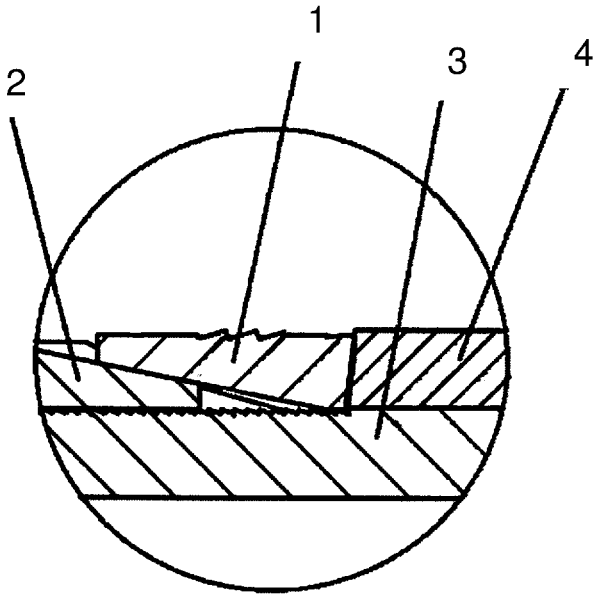
FIG. 4 is a structural diagram of the part C in FIG. 1.

The structure of the part C in FIG. 1 is shown in FIG. 4. The outer surface of the slip 1 is arranged with a one-way slip anchoring structure configured to restrict the slip 1 from sliding on the inner wall of the wellbore towards the other end of the mandrel 3; the one-way slip anchoring structure is a one-way teeth structure. When the slip 1 moves to left as shown in the Figure, the one-way teeth structure will be anchored rightwards to the inner wall of the wellbore as shown in the figure, so that the slip can't move rightwards; thus, the bridge plug setting efficiency and setting reliability are improved.

Figure 5:
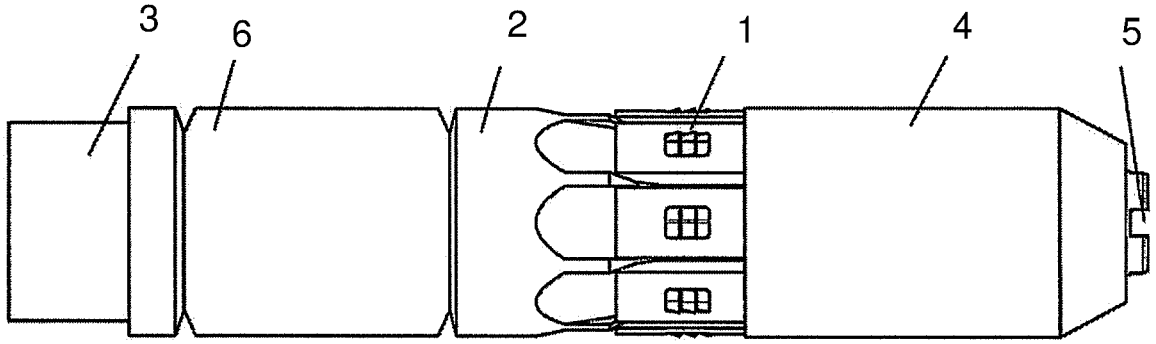
FIG. 5 is a side view of the dissolvable bridge plug.

A side view of the dissolvable bridge plug is shown in FIG. 5. In the figure, the slip 1 has a slip gap, the length direction of the slip gap is parallel to the axis of the mandrel 3, and the slip gap extends from the outer surface of the slip 1 towards the interior of the slip 1. In this embodiment, eight slips 1 are used.

Figure 6:
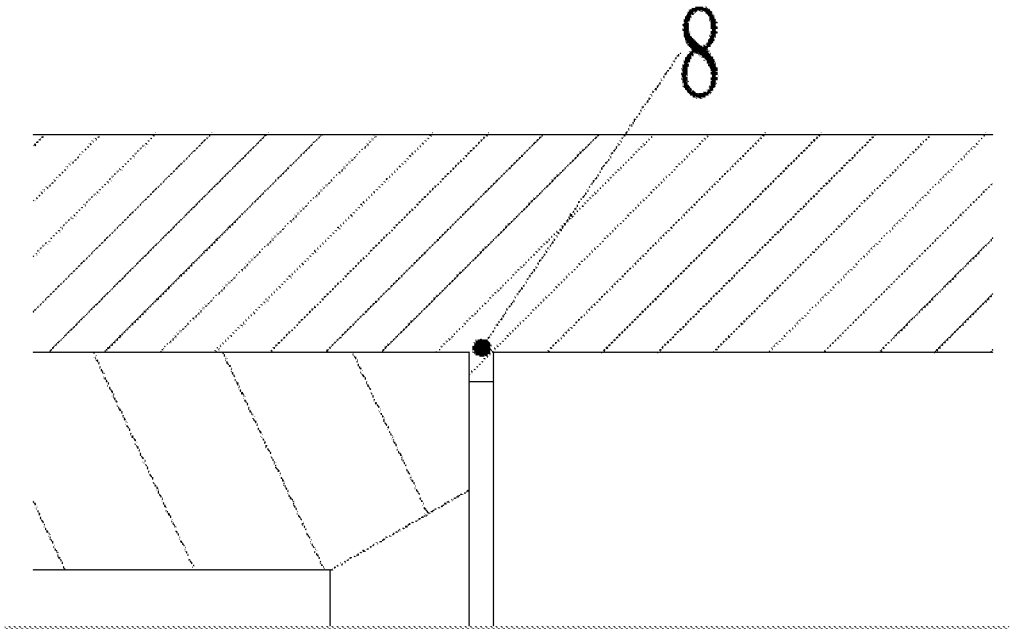
FIG. 6 is an exemplary structural diagram of an anti-preset mechanism in accordance with some implementations of the present disclosure.

An exemplary structure of an anti-preset mechanism 8 is shown in FIG. 6. In this example, the anti-preset mechanism 8 protrudes from the inner surface of the lower sub 4. As shown in FIG. 6, the anti-preset mechanism 8 includes an annular boss structure, and such annular boss structure is an integral part of the lower sub 4.

In the setting process of the bridge plug, the slip will expand and deform outwards under the squeezing force at the two ends. The slip gap is helpful for anchoring the slip to the inner diameter of the wellbore.

In the description of the present invention, it should be appreciated that the orientation or position relations indicated by terms "center", "length", "width", "above", "below", "vertical", "horizontal", "top", "bottom", or "inside", etc., are based on the orientation or position relations indicated on the accompanying drawings. They are used only to ease and simplify the description of the present invention, instead of indicating or implying that the involved device or component must have a specific orientation or must be constructed and operated in a specific orientation. Therefore, the use of these terms shall not be deemed as constituting any limitation to the present invention.

In the present invention, unless otherwise specified and defined explicitly, the terms "install", "connect", "connected", "fix", etc. shall be interpreted in their general meaning, for example, the connection can be fixed connection, detachable connection, or integral connection; can be direct connection or indirect connection via an intermediate medium, or internal communication between two elements or interaction between two elements. Those having ordinary skills in the prior art can interpret the specific meanings of the terms in the present invention in their context.

In the present invention, unless otherwise specified and defined explicitly, a first feature "above" or "below" a second feature may comprise direct contact between the first feature and the second feature, or indirect contact between them via another feature. In addition, a first feature is "above" or "over" a second feature may comprise that the first feature is right above or diagonally above the second feature, or may only represent that the elevation of the first feature is higher than that of the second feature. A first feature being "below" or "under" a second feature may comprise that the first feature is right below or diagonally below the second feature, or may only represent that the elevation of the first feature is lower than that of the second feature.

While the dissolvable bridge plug provided in the present invention and the principle of the present invention are described in detail above in embodiments, it should be appreciated that those embodiments are only provided to facilitate understanding the core idea of the present invention; those having ordinary skills in the art can make modifications to the embodiments and their scope of application on the basis of the idea of the present invention. In summary, the content of this document shall not be understood as constituting any limitation to the present invention.

I claim:

1. A dissolvable bridge plug for temporarily plugging an oil and gas wellbore, comprising a mandrel, a rubber tube, a conical sleeve, a plurality of slips, and a lower sub, wherein the mandrel is a hollow structure with a limiting boss arranged on one end of the mandrel the limiting boss being configured to be abutted against a sleeve of a setting tool adapter when in use, the rubber tube being slidably fitted over an outer surface of the mandrel, the conical sleeve being slidably fitted over the outer surface of the mandrel with the rubber tube between the limiting boss and the conical sleeve, wherein a smaller end of the conical sleeve is away from one side of the rubber tube, and one end of the rubber tube contacts the limiting boss; the plurality of slips are disposed on a conical surface of a conical sleeve, one end of the lower sub is slidably fitted over an other end of the mandrel and abuts against the plurality of slips, an other end of the lower sub is connected with the setting tool adapter via threads on an inner surface of the other end of the lower sub; wherein the mandrel, rubber tube, conical sleeve, plurality of slips, and lower sub are made of a dissolvable material; an inner surface of the one end of the lower sub is arranged with an anti-preset mechanism that contacts and abuts against the other end of the mandrel, the anti-preset mechanism includes a protruding structure disposed on the inner surface of the lower sub.

2. The dissolvable bridge plug according to claim 1, wherein the anti-preset mechanism is integral with the lower sub, and is arranged with a shearing force value.

3. The dissolvable bridge plug according to claim 1, wherein a one-way locking mechanism configured to prevent the conical sleeve from sliding freely towards the other end of the mandrel is arranged between an inner surface of the conical sleeve and the mandrel, the inner surface of the conical sleeve is arranged with an annular groove in the circumferential direction, the one-way locking mechanism comprises a locking block engaged with the mandrel via one-way limiting teeth, and the locking block is disposed in the annular groove and can move radially in the annular groove.

4. The dissolvable bridge plug according to claim 1, wherein the end surface of the other end of the lower sub is arranged with a guide channel through which a well fluid can flow.

5. The dissolvable bridge plug according to claim 1, further comprising a slip gap between each slip of the plurality of slips, wherein the length direction of the slip gap is parallel to the axis of the mandrel, and the slip gap extends from an outer surface of the slip towards the mandrel.

6. The dissolvable bridge plug according to claim 1, wherein the outer surface of the slip is arranged with a one-way slip anchoring structure configured to restrict the slip from sliding on an inner wall of the wellbore towards the other end of the mandrel.

7. The dissolvable bridge plug according to claim 1, wherein the plurality of slips are evenly distributed on the outer surface of the mandrel in the circumferential direction.

8. The dissolvable bridge plug according to claim 1, wherein the end surface of the one end of the mandrel is arranged in a concave shape.

9. The dissolvable bridge plug according to claim 1, wherein the dissolvable material is dissolved in a water solution at a temperature between 30° C. and 200° C.

* * * * *